US005533450A

United States Patent [19]

Hachiya et al.

[11] Patent Number: 5,533,450

[45] Date of Patent: Jul. 9, 1996

[54] INK FOUNTAIN APPARATUS FOR PRINTING PRESS

[75] Inventors: Tadashi Hachiya, Yokohama; Yukitoshi Takahashi, Kawasaki; Yuji Kohara, Kodaira, all of Japan

[73] Assignee: Tokyo Kikai Seisakusho, Ltd., Tokyo, Japan

[21] Appl. No.: 500,756

[22] Filed: Jul. 11, 1995

[30] Foreign Application Priority Data

Nov. 28, 1994 [JP] Japan ..... 6-316008

[51] Int. Cl.[6] ..... B41F 31/05

[52] U.S. Cl. ..... 101/365

[58] Field of Search ..... 101/365, 363, 101/364, 350, 207, 208–210, 157, 169; 118/261

[56] References Cited

U.S. PATENT DOCUMENTS

| | | | |
|---|---|---|---|
| 2,178,069 | 10/1939 | Crafts | 101/157 |
| 2,948,217 | 8/1960 | Witt | 101/364 |
| 4,123,972 | 11/1978 | Gasparrini | 101/363 |
| 4,393,776 | 7/1983 | Toyoda | 101/365 |
| 5,085,145 | 2/1992 | Ohta et al. | 101/363 |

*Primary Examiner*—J. Reed Fisher
*Attorney, Agent, or Firm*—Armstrong, Westerman, Hattori, McLeland & Naughton

[57] ABSTRACT

An ink fountain apparatus for a printing press includes an inclined member with an ink supply adjusting member which is swingable about an axis parallel with the rotational axis of an ink fountain roller for movement between a first position where ink fountain is formed and a second position where the ink fountain is not formed. Piston rods of hydraulic cylinders are connected to the inclined member via a connection mechanism to move the inclined member between the first position and the second position. Stoppers are also provided to stop the inclined member at the first position. Springs are included in the connection mechanism to press the inclined member against the stoppers. The spring force produced by the springs is smaller than the force produced by the drive means. With this structure, the work load of an operator can be reduced while enhancing the efficiency and safety of his work. Also, it is possible to prevent the inclined member from deforming even when the inclined member contacts the stoppers in different states, thereby guaranteeing smooth adjustment of the ink supply adjusting member and improving the ability of the ink fountain apparatus to supply ink.

5 Claims, 3 Drawing Sheets

INK FOUNTAIN APPARATUS FOR PRINTING PRESS

BACKGROUND OF THE INVENTION

1. Field of the Invention

The present invention relates to an ink fountain apparatus for a printing press, and more particularly to an ink fountain apparatus having an inclined member which can approach and separate from an ink fountain roller, and a mechanism for moving the inclined member.

2. Description of Related Art

In an ink fountain apparatus of an ink supply apparatus for a printing press, ink is stored in an elongated space which has a V-shaped cross section and which is formed by the peripheral surface of an ink fountain roller and an inclined member which includes an ink supply adjusting member having a forward edge located in proximity to the peripheral surface of the ink fountain roller, a pair of side plates disposed at both lateral ends of the ink supply adjusting member, and other members. When the ink fountain roller is rotated, the ink stored in the elongated space is withdrawn through a gap between the peripheral surface of the ink fountain roller and the forward edge of the ink supply adjusting member.

To control the supply of ink, the size of the ink supply outlet, i.e., the gap between the peripheral surface of the ink fountain roller and the forward edge of the ink supply adjusting member is adjusted by advancing and retracting the ink supply adjusting member.

When ink stored in the elongated space having a V-shaped cross section, i.e., in the ink fountain, is replaced or when ink remaining in the ink fountain after completion of printing is removed, the ink fountain apparatus must be washed, cleaned, and subjected to maintenance work.

To facilitate such work, a mechanism is provided to separate the inclined member, which forms the elongated space having a V-shaped cross section, from the ink fountain roller to form a large gap between the inclined member and the ink fountain roller, and to move the inclined member toward the ink fountain roller to return the inclined member to the original position.

Japanese Utility-Model Publication (kokoku) No. 36-6808, Japanese Patent Publication (kokoku) No. 3-63953, Japanese Utility-Model Publication (kokoku) No. 57-13253, Japanese Utility-Model Application Laid-Open No. (kokai) 4-9737 and U.S. Pat No. 4,123,972 disclose conventional mechanisms for moving the inclined member of an ink fountain apparatus.

In the mechanisms disclosed in these documents, means for moving the inclined member are provided under the inclined member. In the mechanisms disclosed in Japanese Utility-Model Publication No. 36-6808 and Japanese Patent Publication No. 3-63953, a toggle mechanism is used as the moving means. In the mechanism disclosed in Japanese Utility-Model Publication No. 57-13253, a link mechanism is used as the moving means. In the mechanism disclosed in U.S. Pat. No. 4,123,972, a worm mechanism is used as the moving means. These mechanisms serving as the moving means are all operated manually to cause the inclined member to approach and separate from the ink fountain roller.

In the mechanism disclosed in Japanese Utility-Model Application Laid-Open No. 4-9737, a hydraulic cylinder is used as the moving means. The piston rod of the hydraulic cylinder which is in direct contact with the inclined member is advanced and retracted to cause the inclined member to approach and separate from the ink fountain roller.

In the manual mechanisms disclosed in Japanese Utility-Model Publication No. 36-6808, Japanese Patent Publication No. 3-63953, Japanese Utility-Model Publication No. 57-13253 and U.S. Pat. No. 4,123,972, the work load of an operator increases when the weight of the inclined member increases, resulting in a decreased work efficiency.

In the mechanism disclosed in Japanese Utility-Model Application Laid-Open No. 4-9737, both lateral ends of the inclined member are pressed against stoppers by a large force produced by the hydraulic cylinder when the inclined member is stopped at a position where it forms an ink fountain after approaching the ink fountain roller. When the positions of the stoppers on which the inclined member abuts slightly differ from each other, the inclined member deforms due to the strong pressing force produced by the hydraulic cylinder. In this case, it becomes difficult to advance and retract the ink supply adjusting member toward and from the ink fountain roller so that the work for adjusting the gap between the forward edge of the ink supply adjusting member and the peripheral surface of the ink fountain roller becomes inconvenient.

SUMMARY OF THE INVENTION

An object of the present invention is to solve the drawbacks of conventional ink fountain apparatuses and to provide an improved ink fountain apparatus for a printing press which can reduce the work load of an operator and enhance the efficiency and safety of his work.

Another object of the present invention is to provide an improved ink fountain apparatus for a printing press which can prevent an inclined member from deforming even when the inclined member contacts a plurality of stoppers in different states, thereby guaranteeing smooth adjustment of an ink supply adjusting member and improving the ability of the ink fountain apparatus to supply ink.

An ink fountain apparatus for a printing press according to the present invention includes an inclined member which is swingable about an axis parallel with the rotational axis of an ink fountain roller for movement between a first position where a forward edge of a sloping bottom surface of the inclined member faces the peripheral surface of the ink fountain roller with a gap serving as an ink supply outlet to form an ink fountain and a second position where the forward edge of the sloping bottom surface of the inclined member separates from the peripheral surface of the ink fountain roller, an ink supply adjusting member which is slidably guided on the sloping bottom surface of the inclined member to adjust the size of the ink supply outlet, drive means connected to the inclined member via connection means to move the inclined member between the first position and the second position, stopper means for stopping the inclined member at the first position, and a spring connecting the inclined member and the drive means and pressing the inclined member against the stopper means, wherein the spring force of the spring is smaller than the force produced by the drive means.

After the inclined member is located at the first position where the inclined member forms the ink fountain, ink is stored in the space so that the ink adheres to the peripheral surface of the ink fountain roller in the space. When the ink fountain roller is rotated, the ink is drawn by the peripheral surface of the ink fountain roller through the ink supply outlet such that a film of ink is formed.

The inclined member located at the first position is pressed against the stopper means by the spring force of the spring, and is held by vibration preventing means to prevent the inclined member from vibrating against the spring force of the spring due to vibration during operation of the printing press.

When the inclined member is retracted to separate from the ink fountain roller during work, such as replacement of ink stored in the ink fountain and removal of ink remaining after completion of printing, the vibration preventing means is first released.

The drive means is then operated so that the inclined member is moved to the second position while being supported by the connection means so that the inclined member separates from the ink fountain roller.

When the inclined member must be moved from the second position to the first position to store ink to be supplied to the ink fountain roller, i.e., when the inclined member must approach the ink fountain roller, the drive means is reversely operated.

As a result, the inclined member is displaced via the connection means. At this time, the weight of the inclined member acts on the spring as a load. The inclined member is moved in such a state while being supported by the connection means so that the inclined member approaches the ink fountain roller. When the inclined member contacts the stopper means, the inclined member stops there (first position) to form a space for storing ink. The inclined member is maintained in a state where it is pressed against the stopper means by the spring force of the spring.

Thereafter, the inclined member is maintained at the first position by the vibration preventing means.

In the ink fountain apparatus according to the present invention, the movement of the heavy inclined member between the first position and the second position is not performed manually but is performed by the drive means such as a hydraulic cylinder. Accordingly, the work load of the operator can be reduced while the efficiency and safety of his work can be increased.

When the inclined member is moved by the drive means to the first position to form a space for storing ink, the inclined member contacts the stopper means. Since the inclined member is pressed against the stopper means by a spring force smaller than the driving force of the drive means, the inclined member does not deform even in the case where the inclined member contacts the stopper means at a plurality of positions in different states. Therefore, the ink supply adjusting member can be moved smoothly. Also, the ability of the ink fountain apparatus to supply ink increases, because unevenness does not occur in the size of the ink supply outlet.

BRIEF DESCRIPTION OF THE DRAWINGS

The present invention is illustrated by the accompanying drawings in which.

DETAILED DESCRIPTION OF PREFERRED EMBODIMENTS

An ink fountain according to an embodiment of the present invention will now be described with reference to the accompanying drawings.

Figure 3:
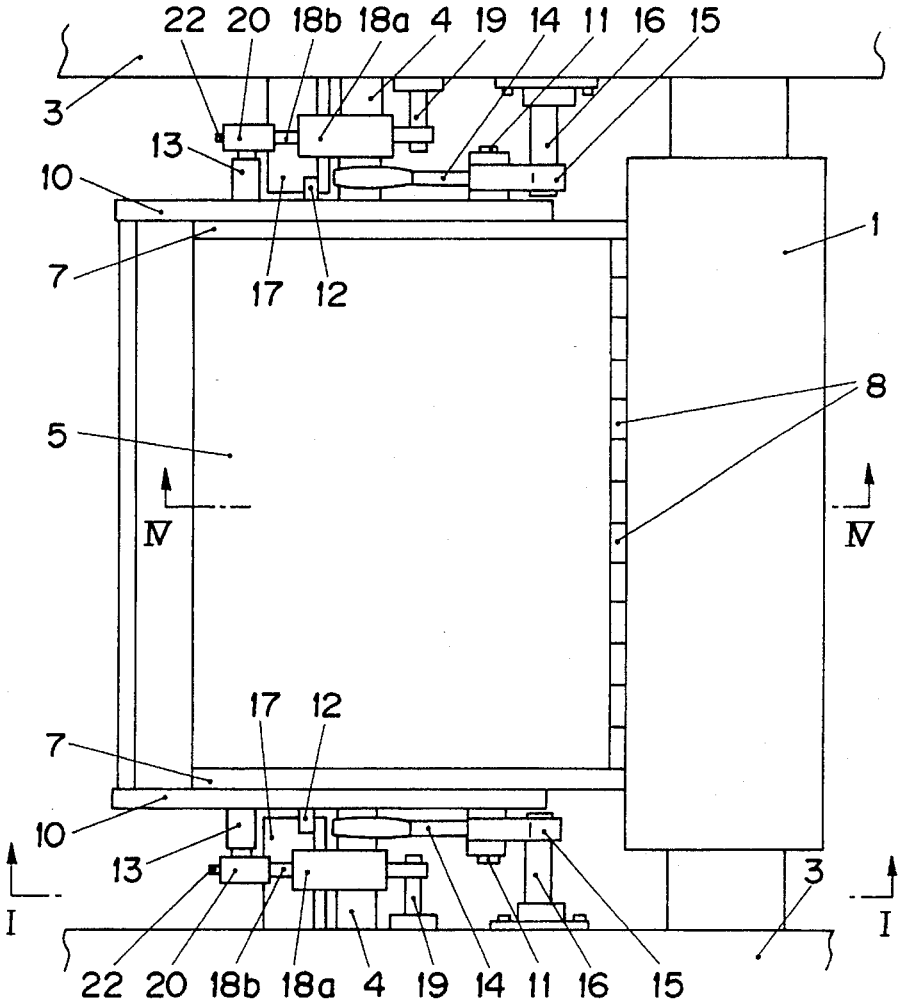
FIG. 3 is a plan view of the ink fountain apparatus according to the embodiment.
Figure 4:
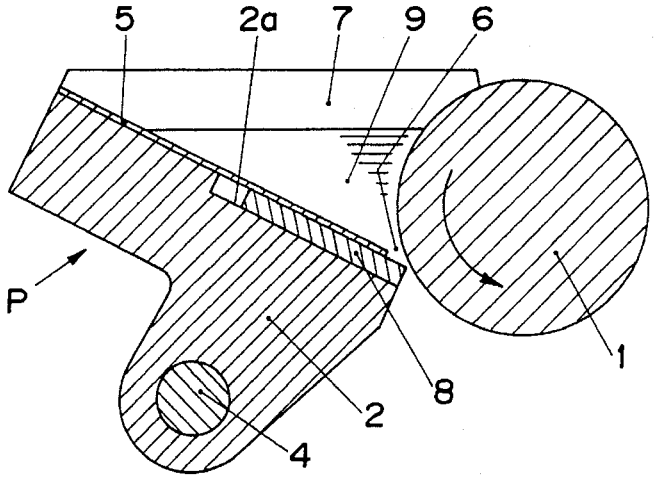
FIG. 4 is a sectional view taken along line IV—IV in FIG. 3.

As shown in FIG. 4, the ink fountain apparatus is provided with an inclined member P which faces an ink fountain roller 1 rotated by an unillustrated drive mechanism in the direction indicated by the arrow (in the counterclockwise direction). The base 2 of the inclined member P is attached to a support rod 4, and both ends of the support rod 4 is rotatably supported by a pair of opposite frames 3 shown in FIG. 3 in parallel with the ink fountain roller 1. The forward edge of the base 2 is parallel with the ink fountain roller 1. The front half of the base 2 has an upper surface which is stepped downward from the upper surface of the rear half of the base 2, thereby providing a sloping surface **2*a* which extends downward toward the ink fountain roller 1**.

The inclined member P is swingable in the counterclockwise direction to a second position such that the forward edge of the inclined member P separates from the peripheral surface of the ink fountain roller 1, i.e., to a position where a later-described elongated space having a V-shaped cross section serving as an ink fountain is not formed.

A bottom plate 5 attached to the upper surface of the rear half of the base 2 extends forward in parallel with the sloping surface **2*a* with a gap corresponding to the step between the upper surfaces of the front and rear halves of the base 2. When the inclined member P is located at its first position where the forward edge of the inclined member P is located in proximity to the peripheral surface of the ink fountain roller 1, the lower edge of the inclined bottom plate 5 faces the peripheral surface of the ink fountain roller 1 and is spaced therefrom by a very small gap, which serves as an ink supply outlet 6. At both lateral ends of the bottom plate 5, a pair of side plates 7 are vertically provided. The side plates 7 have arcuate forward edges which contact the peripheral surface of the ink fountain roller 1**.

Figure 1:
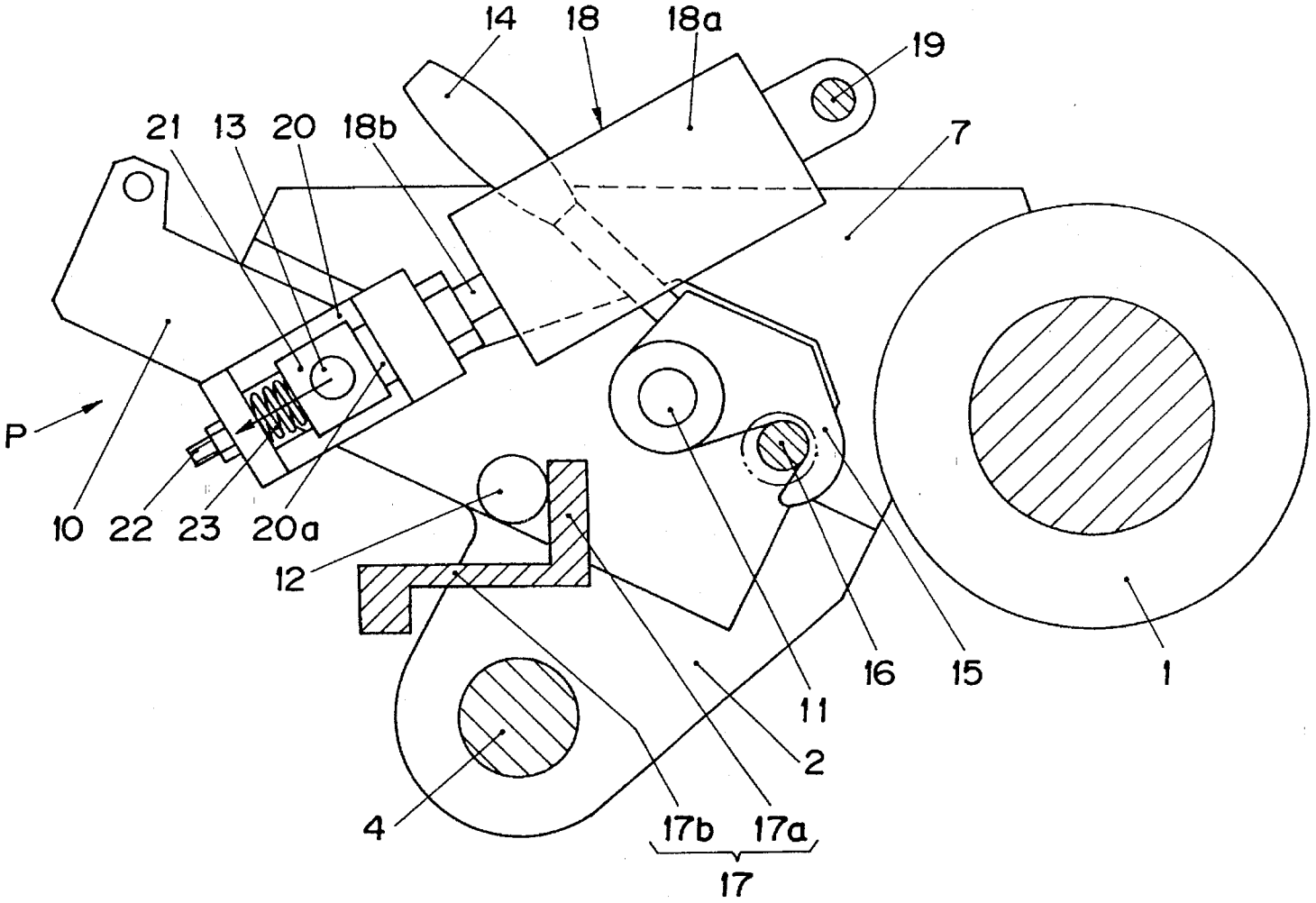
FIG. 1 is a sectional view of an ink fountain apparatus according to an embodiment of the present invention which shows the state where the inclined member is located at its first position (a sectional view taken along line I—I in FIG. 3)

A plurality of ink supply adjusting blade segments 8 are inserted in the space between the sloping surface **2*a* and the bottom plate 5, and are arranged in a row extending parallel with the axis of the ink fountain roller 1 (in the direction perpendicular to the page in FIG. 1). The ink supply adjusting blade segments 8 are slidably guided to advance toward and retract away from the ink fountain roller 1, and their forward edges project beyond the lower edge of the bottom plate 5**.

The bottom plate 5, the projected forward end portions of the ink supply adjusting blades 8, the side plates 7, and the peripheral surface of the ink fountain roller 1 define elongated space 9 having a V-shaped cross section in which ink is stored.

The position of each ink supply adjusting blade segment 8 is adjusted by an unillustrated adjusting mechanism which is provided for each ink supply adjusting blade segment 8 so that the forward edge of the ink supply adjusting blade segment 8 approaches and separates from the peripheral surface of the ink fountain roller 1. As a result, the size of the ink supply outlet 6 between the lower edge of the bottom plate 5 and the peripheral surface of the ink fountain roller 1 is adjusted. In other words, the amount of ink withdrawn is restricted by the gap between the forward edge of the upper surface of the ink supply adjusting blade segments 8 and the peripheral surface of the ink fountain roller 1.

At both lateral sides of the base 2, additional side plates 10 are arranged and are fixed to the outer surfaces of the side plates 7. A support shaft 11, a pin 12 and a support shaft 13 which outwardly extend in parallel with the support shaft 4 are attached to each of the side plates 10 at positions shown in the drawings.

A hook 15 having a handle 14 is rotatably supported by each support shaft 11. A lock pin 16 is attached to each of the inner surfaces of the frames 3 and extends inwardly. The lock pin 16 has a cylindrical base portion fitted into a cylindrical hole formed in the frame 3 and a pin portion eccentrically projecting from the base portion. The hook 15 is engaged with the eccentric pin portion of the lock pin 16.

The positions of the lock pins 16 engagable with the hooks 15 are set such that when the inclined member P is located at the first position, the hooks 15 are allowed to engage with the pin portions of the lock pins 16. The position of the pin portion of each lock pin 16 can be adjusted by rotating the base portion thereof in the hole formed in the frame 3.

Also stoppers 17 are attached to the inner surfaces of the frames 3. Each stopper 7 has a first stopper portion 17*a* on which the pin 12 abuts when the inclined member P is located at the first position and a second stopper portion 17*b* on which the pin 12 abuts when the inclined member P is located at the second position. It is possible to make the first stopper portion 17*a* adjustable in the right-and-left direction so as to adjust the contact between the pin 12 and the first stopper portion 17*a*.

Although the first stopper portion 17*a* and the second stopper portion 17*b* are integrally formed in the embodiment shown in the drawings, they may be separately formed and separately attached to the frame.

Figure 2:
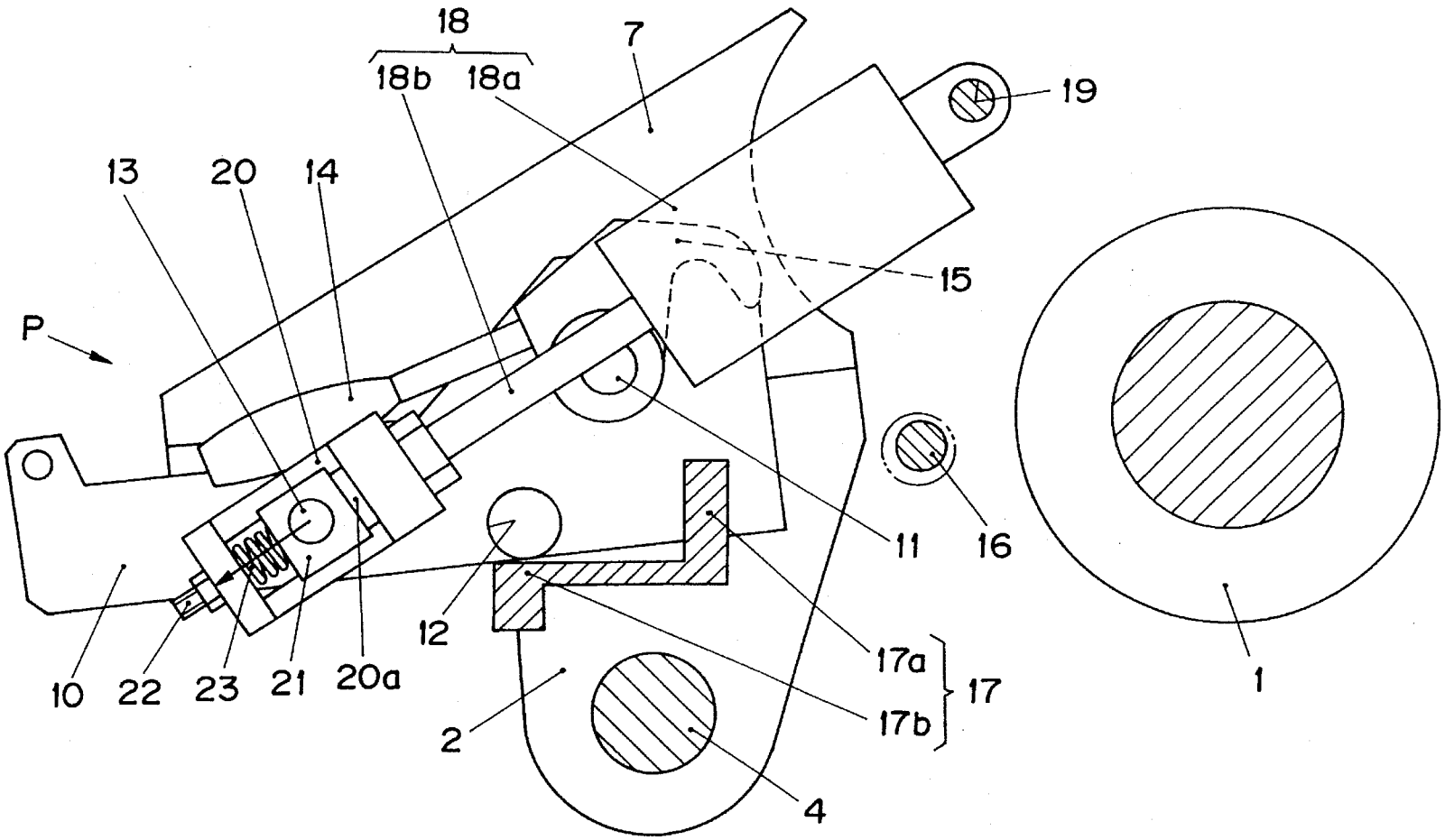
FIG. 2 is a sectional view of the ink fountain apparatus according to the embodiment which shows the state where the inclined member is located at its second position.

On each lateral side of the inclined member P, drive means is provided to move the inclined member between the first position and the second position. FIG. 1 shows a state where the inclined member is positioned at the first position where the elongated space having a V-shaped cross section is formed, and FIG. 2 shows a state where the inclined member is positioned at the second position where the elongated space having a V-shaped cross section is not formed.

The drive means is formed by a pair of hydraulic cylinders 18. The base portion of the cylinder body 18*a* of each hydraulic cylinder 18 is rotatably supported by a support shaft 19 which inwardly extends from the inner surface of the frame 3 in parallel with the support rod 4. The forward end of the piston rod 18*b* of the hydraulic cylinder 18 is connected to the corresponding one of the side plates 10, i.e., the inclined member P, via connection means which will be described later. The position relationship between the drive means and the connection means is determined such that when the piston rods 18*b* of the hydraulic cylinders 18 are retracted, the inclined member P is located at the above-described first position where the elongated space having a V-shaped cross section is formed, and such that when the piston rods 18*b* of the hydraulic cylinders 18 are advanced, the inclined member P is located at the above-described second position where the elongated space having a V-shaped cross section is not formed.

The connection means will be described in detail. Attached to the forward end of each piston rod 18*b* is a support block 20 which extends in the axial direction of the piston rod 18*b* and has a rectangular hole 20*a* which penetrates the support block 20 in the lateral direction, i.e., in a direction parallel with the support rod 4. A movable block 21 is fitted into the rectangular hole 20*a* for movement in the axial direction of the piston rod 18*b*. The movable block 21 is rotatably carried by the forward end of the support shaft 13 which is attached to the outer surface of the side plate 10.

A bolt 22 is screwed into the forward end of each support block 20 such that the bolt 22 extends toward the piston rod 18*b* and projects into the rectangular hole 20*a*. Also, a compression spring 23 is disposed in the rectangular hole 20*a* and is supported by the bolt 22 so that the spring 22 exists between the front wall of the rectangular hole 20*a* and the front end surface of the movable block 21 in a compressed state. The compression spring 23 presses the movable block 21 in the retracting direction of the piston rod 18*b* with a force smaller than the force produced by the hydraulic cylinder 18.

The operation of the above-described ink fountain apparatus is as follows.

When the inclined member P is located at the first position to form elongated space 9 serving as an ink fountain, as shown in FIG. 4, the ink is stored in the elongated space 9. The ink stored in the elongated space 9 adheres to the peripheral surface of the ink fountain roller 1. When the ink fountain roller 1 is rotated in the direction indicated by the arrow in FIG. 4 (in the counterclockwise direction), the ink is drawn from the space at a rate corresponding to the size of the ink supply outlet 6 which is restricted by the forward edges of the upper surfaces of the ink supply adjusting blade segments 8, i.e., at a rate corresponding to the gap between the forward edges of the ink supply adjusting blade segments 8 and the peripheral surface of the ink fountain roller 1. The ink drawn from the space adheres to the peripheral surface of the ink fountain roller 1 so that a film of ink is formed thereon.

When the inclined member P is located at the first position, the piston rods 18*b* of the hydraulic cylinders 18 are in their second positions so that the movable blocks 21 are centrally situated in the rectangle spaces 20*a* of the support blocks 20. At this time, the compression springs 23 are in a slightly compressed state so that the pins 12 of the side plates 10 are pressed against the first stopper portions 17*a* by the spring forces of the springs 23.

Since there is a possibility that the inclined member P vibrates against the spring forces of the compression springs 23 due to vibration during operation of the printing press, the handles 14 are manually raised to engage the hooks 15 with the pin portions of the lock pins 13. With this operation, the inclined member P is stably held while being prevented from vibrating. When the engagement between the hook 15 and the pin portion of the lock pin 13 is too loose or too tight, the base portion of the lock pin 13 is rotated in the hole formed in the frame 3 to move the eccentric pin portion. With this adjustment, the engagement between the hook 15 and the pin portion of the lock pin 13 is properly set such that the inclined member P is prevented from vibrating and is prevented from deforming.

When the ink fountain apparatus is washed, cleaned and subjected to maintenance work in connection with work such as replacement of ink stored in the elongated space and removal of ink remaining after completion of printing, the inclined member P is retracted to the second position shown in FIG. 2 where the elongated space is not formed, i.e., the inclined member P is caused to separate from the ink fountain roller 1. In this case, the handles 14 are first pressed down by a manual operation to disengage the hooks 15 from the pin portions of the lock pins 13.

The hydraulic cylinders 18 are then operated to advance the piston rods 18*b* so that the support blocks 20 are moved in a direction such that they separate from the ink fountain roller 1. With this operation, the inclined member P is rotated about the support rod 4 in the counterclockwise direction in a state in which a component of a force due to the weight of the inclined member P in a direction parallel with the hydraulic cylinders 18 is borne by the compression springs 23 and the bolts 22 via the side plates 10, the support shafts 13, and the movable blocks 21. Thus, the inclined member P separates from the ink fountain roller 1, and the hydraulic cylinders 18, the support shafts 13 and the movable blocks 21 are also rotated about the support shafts 19 in the counterclockwise direction.

At this time, the pins 12 separate from the first stopper portions 17*a* of the stoppers 17, and contact the second stopper portions 17*b* of the stoppers 17 as the advancing movement of the piston rod 18*b*, i.e., the rotation of the inclined member P proceeds. When the pins 12 contact the second stopper portions 17*b*, the inclined member P is stopped at the second position where the elongated space having a V-shaped cross section is not formed. When the piston rods 18*b* are further advanced by a slight amount and reach their stroke ends, the compression springs 23 are restored by an amount corresponding to the amount of advancing movement of the piston rods 18*b* after the inclined member P stops, because the inclined member P, i.e., the movable blocks 21, are maintained stationary.

When the inclined member P is moved from the second position shown in FIG. 2 to the first position shown in FIG. 1 to store ink to be supplied to the ink fountain roller 1, i.e., when the inclined member P is caused to approach the ink fountain roller 1, the hydraulic cylinders 18 are first operated to retract the piston rods 18. At this time, a component of the force due to the weight of the inclined member P in a direction parallel with the hydraulic cylinders 18 acts on the compression springs 23 via the side plates 10, the support shafts 13, and the movable blocks 21 so that the compression springs 23 are compressed. When the spring force of the compression springs 23 becomes equal to the component of the force or when the tips of the bolts 22 contact the movable blocks 21, the inclined member P is rotated about the support rod 4 in the clockwise direction in FIG. 1 while being supported by the compression springs 23 or the bolts 22 via the side plates 10, the support shafts 13 and the movable blocks 21. Thus, the inclined member P approaches the ink fountain roller 1, and the hydraulic cylinders 18, the support shafts 13 and the movable blocks 21 are also rotated about the support shafts 19 in the clockwise direction so that the pins 12 separate from the second stopper portions 17*b* of the stoppers 17.

Since the component of the force gradually decreases as the piston rods 18*b* of the hydraulic cylinders 18 move, the compression springs 23 are restored while pressing back the movable blocks 21.

When the retracting movements of the piston rods 18, i.e., the rotation of the inclined member P in the clockwise direction proceeds and the pins 12 contact the first stopper portions 17*a* of the stoppers 17, the inclined member P is stopped at the first position where the elongated space having a V-shaped cross section is formed.

When the piston rods 18*b* are further retracted by a slight amount and reach the other stroke ends, the compression springs 23 are compressed by an amount corresponding to the amount of retracting movement of the piston rods 18*b* after the inclined member P stops, because the inclined member P, i.e., the movable blocks 21 are maintained stationary. As a result, a state is maintained where the pins 12 are pressed against the first stopper portions 17*a* of the stoppers 17 by the compressed compression springs 23.

Since the force produced by the compression springs 23 is smaller than the force produced by the hydraulic cylinders 18, the inclined portion P, especially, the base 2, is prevented from deforming even when the first stopper portion 17*a* of the stopper 17 provided at one lateral side contacts one of the pins 12 in a state different from the state in which the first stopper portion 17*a* of the stopper 17 provided at the other lateral side contacts the other pin 12.

Subsequently, the handles 14 are manually raised to engage the hooks 15 with the pin portions of the lock pins 13, so that the inclined member 14 is stably held in the position where the elongated space having a V-shaped cross section is formed.

Although the present invention has been described above with respect to typical preferred embodiments thereof, it should of course be understood that the invention is not limited to these embodiments, and various changes or modifications may be made without departing from the scope of the invention as defined by the appended claims.

What is claimed is:

1. An ink fountain apparatus for a printing press comprising:

a frame;

an ink fountain roller rotatably mounted on said frame;

an inclined member which is swingable about an axis parallel with the rotational axis of the ink fountain roller for movement between a first position in which a forward edge of a sloping bottom surface of the inclined member is placed closely adjacent the peripheral surface of the ink fountain roller to produce a gap serving as an ink supply outlet forming an ink fountain, and a second position in which the forward edge of the sloping bottom surface of the inclined member separates from the peripheral surface of the ink fountain roller;

an ink supply adjusting member which is slidably guided on the sloping bottom surface of said inclined member with respect to the forward edge thereof to adjust the size of the ink supply outlet;

drive means connected to said inclined member via connection means to pivotally move said inclined member between the first position and the second position;

a stopper means including a limit stop fixedly secured to said frame and a pin movable with said inclined member cooperable with said limit stop for stopping said inclined member at the first position; and a spring having a spring force smaller than a force produced by said drive means connecting said inclined member and said drive means and being operable to apply a pressure force between said pin on said inclined member against said limit stop when said inclined member is disposed in said first position.

2. An ink fountain apparatus for a printing press according to claim 1, wherein said drive means, said stopper means and said spring are provided at both lateral sides of said inclined member.

3. An ink fountain apparatus for a printing press according to claim 2, wherein said drive means comprises a hydraulic cylinder.

4. An ink fountain apparatus for a printing press comprising:

an inclined member which is swingable about an axis parallel with the rotational axis of an ink fountain roller for movement between a first position where a forward edge of a sloping bottom surface of the inclined member faces the peripheral surface of the ink fountain roller with a gap serving as an ink supply outlet, thereby forming an ink fountain and a second position where the forward edge of the sloping bottom surface of the inclined member separates from the peripheral surface of the ink fountain roller;

an ink supply adjusting member which is slidably guided on the sloping bottom surface of said inclined member to adjust the size of the ink supply outlet;

drive means including a hydraulic cylinder connected to said inclined member via connection means to move said inclined member between the first position and the second position;

stopper means for stopping said inclined member at the first positions; and a spring connecting said inclined member and said drive means and pressing said inclined member against said stopper means, in which a spring force produced by said spring is smaller than a force produced by said drive means, wherein said connection means comprises a side plate attached to said inclined member, a support block attached to a forward end of a piston rod of said hydraulic cylinder and having a rectangular hole therein, a movable block guided in the rectangular hole of said support block, and a shaft which connects said movable block to said side plate, and wherein said spring is disposed between a front end surface of said movable block and a front wall of the rectangular hole of said support block.

5. An ink fountain apparatus for a printing press according to claim 1 including a releasable lock means for securing said inclined member with respect to said ink fountain roller when said inclined member is in said first position.

* * * * *